US010589158B2

(12) United States Patent
Boatright et al.

(10) Patent No.: US 10,589,158 B2
(45) Date of Patent: Mar. 17, 2020

(54) BASKETBALL SHOOTING AID

(71) Applicant: Wichita State University, Wichita, KS (US)

(72) Inventors: Darron Boatright, Wichita, KS (US); Kimberly M. Reuter, Wichita, KS (US); Jason M. DeGarmo, Wichita, KS (US)

(73) Assignee: Wichita State University, Wichita, KS (US)

( * ) Notice: Subject to any disclaimer, the term of this patent is extended or adjusted under 35 U.S.C. 154(b) by 0 days.

(21) Appl. No.: 16/148,777

(22) Filed: Oct. 1, 2018

(65) Prior Publication Data

US 2019/0099648 A1 Apr. 4, 2019

Related U.S. Application Data

(60) Provisional application No. 62/565,856, filed on Sep. 29, 2017.

(51) Int. Cl.

| | |
|---|---|
| ***A63B 69/00*** | (2006.01) |
| ***A63B 63/08*** | (2006.01) |
| ***A63B 71/06*** | (2006.01) |

(52) U.S. Cl.

CPC ..... *A63B 69/0071* (2013.01); *A63B 63/083* (2013.01); *A63B 71/0622* (2013.01); *A63B 2207/02* (2013.01); *A63B 2208/12* (2013.01); *A63B 2209/10* (2013.01); *A63B 2220/56* (2013.01); *A63B 2220/801* (2013.01); *A63B 2220/833* (2013.01); *A63B 2243/0037* (2013.01)

(58) Field of Classification Search

CPC ..... A63B 69/0071; A63B 63/083; A63B 2220/833; A63B 2243/0037

USPC ..... 473/422, 433, 447–448, 479–489

See application file for complete search history.

(56) References Cited

U.S. PATENT DOCUMENTS

| | | | | | |
|---|---|---|---|---|---|
| 2,039,794 | A * | 5/1936 | Hayden | A63B 63/083 | 473/448 |
| 3,814,421 | A * | 6/1974 | Spier, Jr. | A63B 63/083 | 473/433 |
| 4,836,539 | A * | 6/1989 | Knapp | A63B 63/083 | 473/433 |
| 4,877,241 | A * | 10/1989 | Rothbard | A63B 63/083 | 473/485 |
| 5,156,394 | A * | 10/1992 | Deal | A63B 63/083 | 473/485 |

(Continued)

*Primary Examiner* — Mitra Aryanpour
(74) *Attorney, Agent, or Firm* — Stinson LLP

(57) ABSTRACT

A basketball shooting aid includes a sidewall having an upper surface, a lower surface, an inner surface, and an outer surface. The upper surface of the sidewall defines an upper orifice and the lower surface of the sidewall defines a lower orifice, wherein the upper orifice has an upper orifice diameter and the lower orifice has a lower orifice diameter. The upper orifice diameter is greater than the lower orifice diameter such that the inner surface defines an intermediate orifice having a continuously tapering diameter, and the lower orifice diameter is substantially similar to the rim diameter of the existing basketball rim. The basketball shooting aid also comprises a shock-absorbing gasket and a damping layer. The shock-absorbing gasket is sandwiched between the sidewall and the existing basketball rim when the basketball shooting aid is retrofitted onto said existing basketball rim.

15 Claims, 12 Drawing Sheets

(56) References Cited

U.S. PATENT DOCUMENTS

| | | | | |
|---|---|---|---|---|
| 5,879,247 | A | 3/1999 | Winter et al. | |
| 6,932,723 | B1 * | 8/2005 | Klinger | A63B 69/0071 473/422 |
| 7,402,116 | B2 | 7/2008 | Zuccarini | |
| 7,597,635 | B2 * | 10/2009 | Davies | A63B 69/0071 473/433 |
| 8,062,152 | B2 | 11/2011 | Nye et al. | |
| 2004/0152543 | A1 * | 8/2004 | Kershaw | A63B 63/083 473/485 |
| 2007/0082759 | A1 * | 4/2007 | Burkhardt | A63B 63/083 473/448 |
| 2011/0312448 | A1 | 12/2011 | McIlvain et al. | |
| 2015/0265897 | A1 * | 9/2015 | Gordon | A63B 69/0071 473/447 |

* cited by examiner

BASKETBALL SHOOTING AID

CROSS-REFERENCE TO RELATED APPLICATIONS

This application claims priority to U.S. Provisional Application Ser. No. 62/565,856, filed Sep. 29, 2017, titled "Youth Basketball Training and Encouragement System." The disclosure of the prior application is considered part of (and is incorporated by reference in) the disclosure of this application.

TECHNICAL FIELD

This specification generally describes a basketball shooting aid for retrofitting onto an existing basketball rim.

BACKGROUND

Sports players gain confidence and build self-esteem in themselves as they acquire new skills and their abilities improve. Basketball is a sport able to be played all year, regardless of family income or geography, as basketball hoops are often available at local parks, schools, or recreational facilities, if not in a person's own driveway. Basketball is similar in some aspects to other sports, where the skill of a player is associated with the success the player has playing said sport. Basketball is not always easy for lower-skilled or younger players to stay engaged and practice in order to develop their skills. For example, youth basketball games are often very low scoring and youth players can get discouraged as they attempt to make baskets and repeatedly do not have the ball go through the rim.

Adjustable height basketball goals have been known in the field and commercially available for decades, where the basketball goal can be lowered for lower skill level players and raised for higher skilled players. Other documents disclose devices or aides for retrofitting onto existing basketball rims that decrease the available rim size and are often designed for higher skilled players to increase their shooting skill. Some documents disclose rims systems that are contractible, where the available rim size can get smaller and are often designed for higher skilled players to increase their shooting skill.

There are previous disclosures having expandable rim systems or devices for retrofitting onto existing basketball rims to increase the available rim size, however there are concerns with said previous disclosures that arise surrounding aspects of mechanical stability, durability, implementation, and/or ease-of-use.

SUMMARY

The following disclosure describes a basketball shooting aid for retrofitting onto an existing basketball rim having a rim diameter.

In one embodiment, the basketball shooting aid may include a sidewall having an upper surface, a lower surface, an inner surface, and an outer surface. The upper surface of the sidewall defines an upper orifice and the lower surface of the sidewall defines a lower orifice. The upper orifice has an upper orifice diameter and the lower orifice has a lower orifice diameter. The upper orifice diameter is greater than the lower orifice diameter such that the inner surface angles from the upper surface to the lower surface. The lower orifice diameter is substantially similar to the rim diameter of the existing basketball rim.

The basketball shooting aid may include a shock-absorbing gasket connected to the lower surface of the sidewall and a damping layer covering the inner surface of the sidewall. The damping layer may absorb energy associated with an incoming basketball. The shock-absorbing gasket is sandwiched between the sidewall and the existing basketball rim when the basketball shooting aid is retrofitted onto said existing basketball rim.

In one aspect, the basketball shooting aid may also include a processor, a power source, at least one piezoelectric sensor, at least one proximity sensor, and at least one light-emitting device.

In another embodiment, the basketball shooting aid may also be arranged such that the sidewall is a lower sidewall, and further includes an upper sidewall that may be removably connected to the lower sidewall. The upper sidewall has an upper surface, a lower surface, an inner surface, and an outer surface. The upper surface of the upper sidewall defines an upper orifice and the lower surface of the upper sidewall defines a lower orifice, wherein the upper orifice has an upper orifice diameter and the lower orifice has a lower orifice diameter. The upper orifice diameter is greater than the lower orifice diameter such that the inner surface angles from the upper surface to the lower surface. The lower orifice diameter of the upper sidewall is substantially similar to an upper orifice diameter of the lower sidewall.

The basketball shooting aid may also include a shock-absorbing gasket connected to the lower surface of the upper sidewall and a damping layer covering the inner surface of the upper sidewall. The damping layer may absorb energy associated with an incoming basketball. The shock-absorbing gasket is sandwiched between the upper sidewall and lower sidewall when said upper sidewall is removably connected to said lower sidewall.

BRIEF DESCRIPTION OF THE DRAWINGS

Embodiments of the disclosure as described in detail below with reference to the attached drawing figures, wherein.

Figure 1:
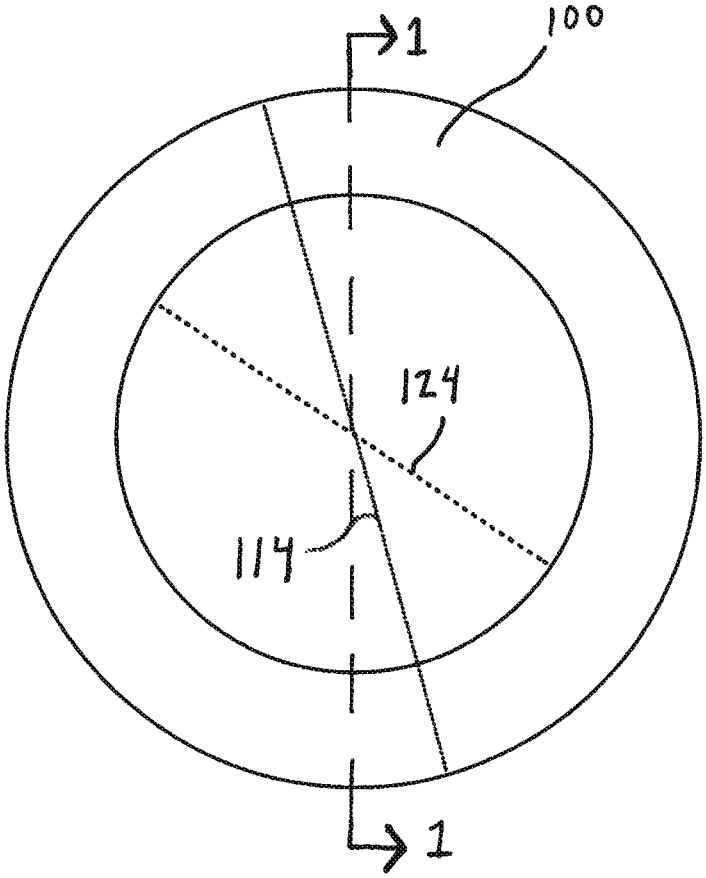
FIG. 1 is a top-view of a preferred embodiment of a basketball shooting aid.

The drawing figures do not limit the disclosure to the specific embodiments disclosed and are described herein. The drawings are not necessarily to scale, emphasis instead being placed upon clearly illustrating the principles of the disclosure.

DETAILED DESCRIPTION OF THE DISCLOSURE

The following detailed description of the disclosure references the accompanying drawings that illustrate specific embodiments in which the disclosure can be practiced. The embodiments are intended to describe aspects of the disclosure in sufficient detail to enable those skilled in the art to practice the disclosure. Other embodiments can be utilized and changes can be made without departing from the scope of the disclosure. The following detailed description is, therefore, not to be taken in a limiting sense. The scope of the disclosure is defined only by the appended claims, along with the full scope of equivalents to which such claims are entitled.

In this description, references to "one embodiment," "an embodiment," or "embodiments" mean that the feature or features being referred to are included in at least one embodiment of the disclosure. Separate references to "one embodiment," "an embodiment," "an alternate embodiment," or "embodiments" in this description do not necessarily refer to the same embodiment and are also not mutually exclusive unless so stated and/or except as will be readily apparent to those skilled in the art from the description. For example, a feature, component, function, etc. described in one embodiment may be included in other embodiments, but is not necessarily included. Thus, the disclosure can include a variety of combinations and/or integrations of the embodiments described herein.

Definitions

For this disclosure, certain terms are defined to provide clarity and/or reduce ambiguity associated with said general terms that may have more than one substantive meaning.

"Hardness" is used to describe a material's ability to resist deformation when a pressure or force is applied to it. Common terms to describe a material that is "hard" can include solid, rigid, firm, stiff, or inflexible.

"Orifice" is used to describe an opening, hole, or void that passes through a body or structure. In this disclosure, an "orifice" is used to describe an element that is substantially circular, as such has planar properties similar to a circle including a diameter and a surface area. Therefore, an "orifice" is described as having a "diameter" and a "surface area", and are used as terms in an attempt to quantify a distance or area associated with an orifice.

"Sandwiched" is used to describe a material being compressed or squeezed between two harder materials. In this disclosure, "sandwiched" may also be used to describe when a material being compressed between a first hard material and a second hard material, such that the two hard materials may be set against each other. For this disclosure, the term "sandwiched" may include that in a system having at least one hard material, two hard materials may be held together in a secure and/or uniform manner with a compressible material in between the two hard materials such that if an external force and/or energy is applied to said system, the said system can perform functions and operations that the system is configured to do.

In this disclosure, terms such as "elements" or "components" may be used to describe physical parts that may be found in the disclosure. The terms "aspects" and "features" may be used to describe characteristics of "elements" or "components" within an embodiment of the disclosure.

The phrase "at least one (element) . . . " may be used to describe that in certain embodiments, an element) may be a singular element, but in other embodiments, the element may have more than one element. Therefore, if an element is first described using the phrase "at least one (element)", then it is acceptable to describe said element as "element(s)".

Figure 2:
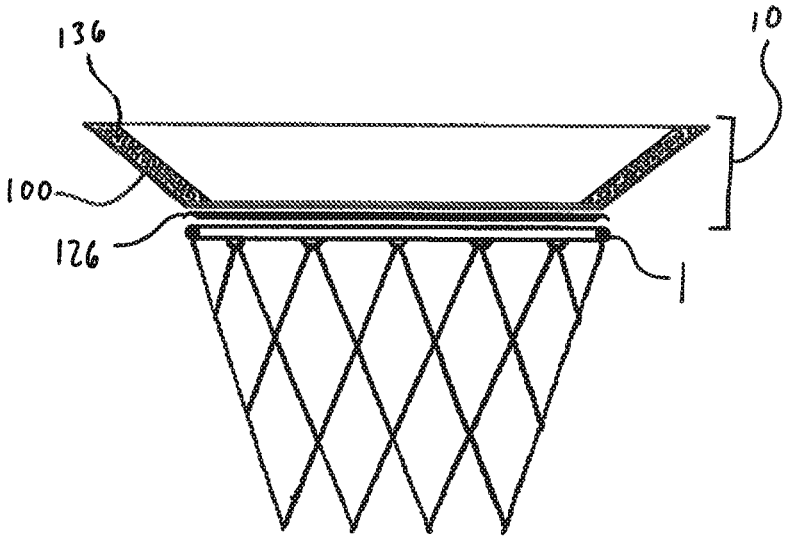
FIG. 2 is a cross-section view of the preferred embodiment shown in FIG. 1, the cross-section view being taken along line 1-1.
Figure 4:
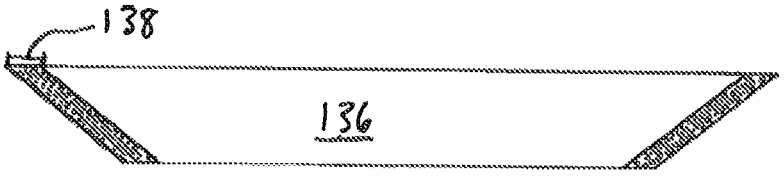
FIG. 4 is a cross-section view of a damping layer.

To begin illustrating various embodiments of the disclosure described by the attached figure drawings, FIG. 2 describes an embodiment of a basketball shooting aid 10 for retrofitting onto an existing basketball rim 1 having a rim diameter 2. In FIG. 4, the basketball shooting aid 10 may include a sidewall 100 having an upper surface 110, a lower surface 120, an inner surface 130, and an outer surface 140. The upper surface 110 of the sidewall 100 defines an upper orifice 112 and the lower surface 120 of the sidewall defines a lower orifice 122, wherein the upper orifice 112 has an upper orifice diameter 114 and the lower orifice 122 has a lower orifice diameter 124. The upper orifice diameter 114 may be greater than the lower orifice diameter 124 such that the inner surface 130 angles from the upper surface 110 to the lower surface 120. The lower orifice diameter 114 may be substantially similar to the rim diameter 2 of the existing basketball rim 1.

Figure 3:
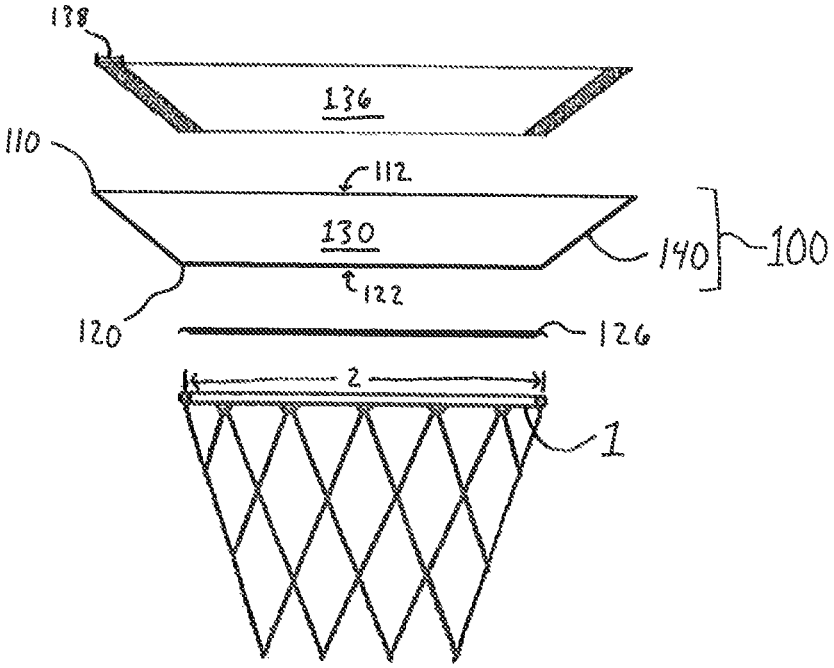
FIG. 3 is an exploded view of FIG. 2.

Referencing FIG. 3, a basketball shooting aid 10 may include a shock-absorbing gasket 126 connected to a lower surface 120 of a sidewall 100 and a damping layer 136 covering an inner surface 130 of the sidewall 100. The damping layer 136 may be configured to absorb energy associated with an incoming basketball, and the shock-absorbing gasket 126 may be sandwiched between the sidewall 100 and the existing basketball rim 1 when the basketball shooting aid 10 is retrofitted onto said existing basketball rim 1.

In one aspect, a lower orifice diameter 124 of the sidewall may be about 18 inches, and the upper orifice diameter 114 may be between 20 inches to 28 inches. In certain embodiments, the upper orifice diameter 114 may be between 22 and 26 inches.

In another aspect, a sidewall 100 has a height defined as a distance between an upper surface 110 and a lower surface 120, the height being less than a lower orifice diameter 124. In certain embodiments, the height of the sidewall may be between 2 inches to 10 inches.

In one aspect, a sidewall 100 has a first hardness, the shocking absorbing gasket 126 has a second hardness, and the damping layer 136 has a third hardness. The first hardness is greater than the second hardness, and the first hardness is greater than the third hardness.

In another aspect, a damping layer 136 may be made of at least one material selected from, but not limited to, rubber, rubberized foam, closed-cell foam, high-density foam, open-cell foam, and any combination of materials thereof.

In FIG. 4, a damping layer 136 may cover an inner surface 130 of a sidewall 100 at a desired thickness 138. It can be appreciated that the desired thickness 138 of the damping layer 136 is directly associated with the amount of energy said damping layer is able to absorb, where the amount of energy able to be absorbed is, in conjunction with its thickness, an inherent mechanical property of a material the damping layer may be made of. In certain embodiments, a damping layer 136 may have a desired thickness 138 of the damping layer may range between ¼ inch and 2 inches.

In another aspect, a surface area associated with an upper orifice 112 may be between 110% and 250% larger than a surface area associated with a lower orifice 122. In certain embodiments, a surface area associated with the upper orifice 112 may be between 115% and 210% larger than a surface area associated with the lower orifice 122.

Figure 5:
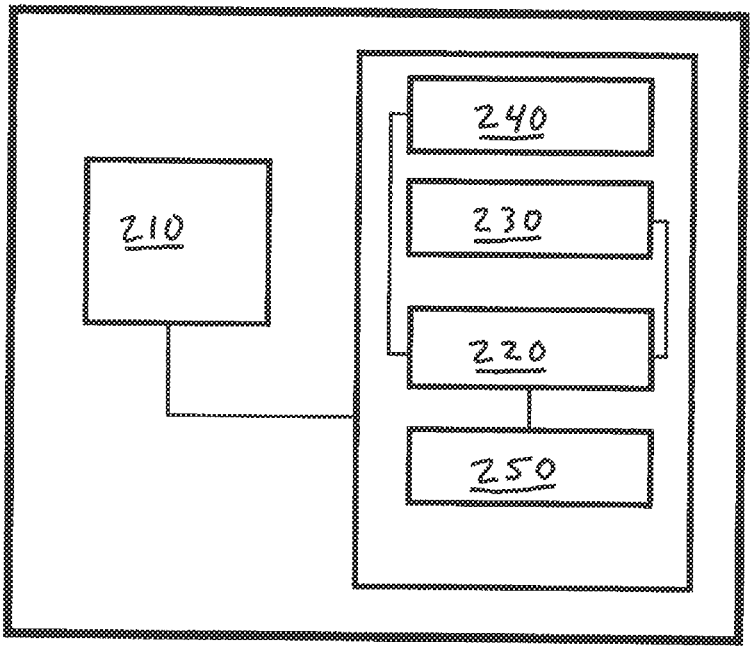
FIG. 5 is a schematic showing an arrangement of electrical components.

In certain embodiments described by FIG. 5, a basketball shooting aid 10 may further include a processor 220, a power source 210, at least one piezoelectric sensor 230, at least one proximity sensor 240, and at least one light-emitting device 250. The power source 210 is connected to the processor 220, the proximity sensor(s) 230, the piezoelectric sensor (s) 240, and the light-emitting device(s) 250. The power source 210 may deliver adequate amounts of energy for the processor, the proximity sensor(s), the piezoelectric sensor(s), and the light-emitting device(s) to operate. The power source 210 can include, but not limited to, a battery, rechargeable capacitator, or a solar panel in combination with a rechargeable capacitator.

Figure 6:
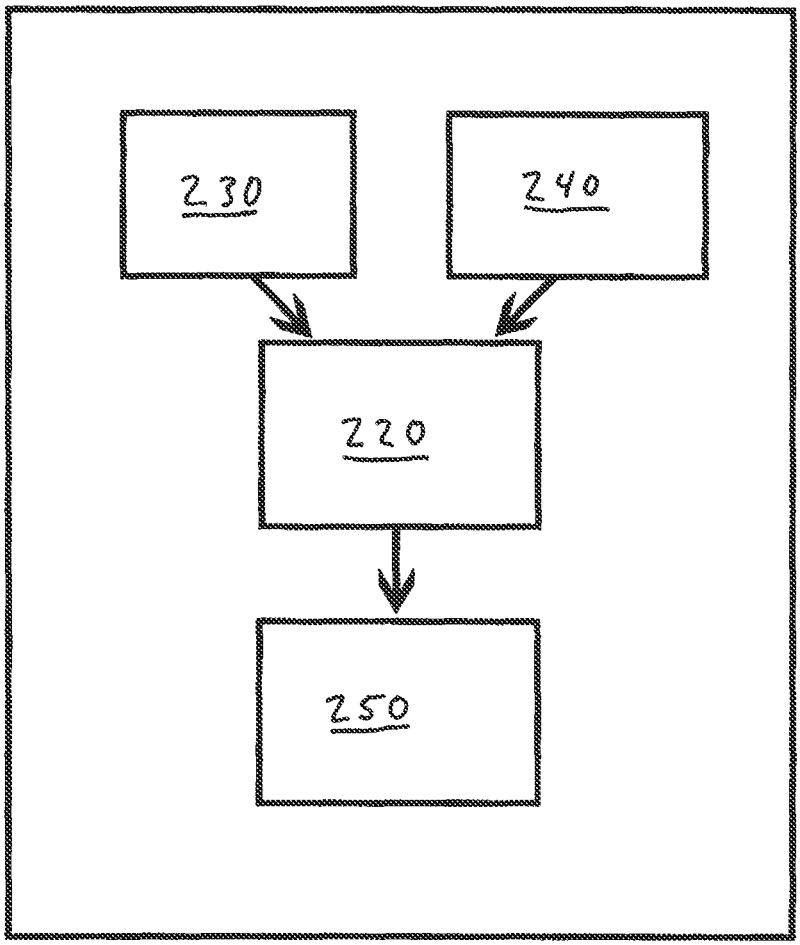
FIG. 6 is a schematic drawing showing flow of detection responses associated with electrical components.

Illustrated in FIG. 6, a processor 220 may be configured to collect and record at least one detection response detected by a piezoelectric sensor(s) 230 and a proximity sensor(s) 240. The processor 220 may also be configured to form at least one instruction based off the detection response(s) collected from the piezoelectric sensor(s) 230 and the proximity sensor(s) 240. The processor 220 may further be configured to deliver the instruction(s) to the light-emitting device(s) 250. A processor may be any processor known to the art that can perform a computer-implemented method, where the processor may receive, execute, and/or send instructions to connected electrical components. Examples of processors known in the art may include, but not limited to, a computer, Arduino, microprocessor, or smartphone.

Figure 7:
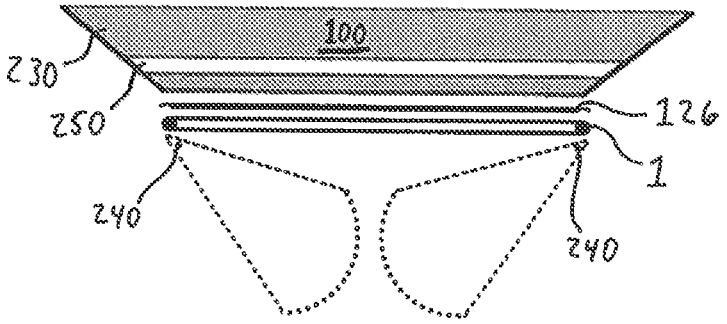
FIG. 7 illustrates a side-view of another preferred embodiment of a basketball shooting aid including electrical components.

Described in FIG. 7, a piezoelectric sensor(s) 230 may be connected to a sidewall 100. The piezoelectric sensor(s) 230 may be configured to detect a vibration associated with an impact from an incoming basketball. Examples of piezoelectric sensor(s) known to the art may include any piezoelectric sensor, or optionally a pressure sensor, that may be able to form a detection response when a vibration, pressure, and/or external force is applied to the sidewall.

Also described in FIG. 7, a proximity sensor(s) 240 may be adjacent to a lower orifice 112. The proximity sensor(s) 240 may be configured to detect a movement associated with an incoming basketball. Examples of proximity sensor(s) can include any proximity sensor known to the art that can detect movement within a certain radius of the sensor.

Also described in FIG. 7, a light-emitting device(s) 250 may be connect to an outer surface 140 of a sidewall 100. The light-emitting device(s) 250 may receive instruction(s) from a processor 220 that may indicate a detection response by a proximity sensor(s) 240 and/or a piezoelectric sensor 230.

Figure 8:
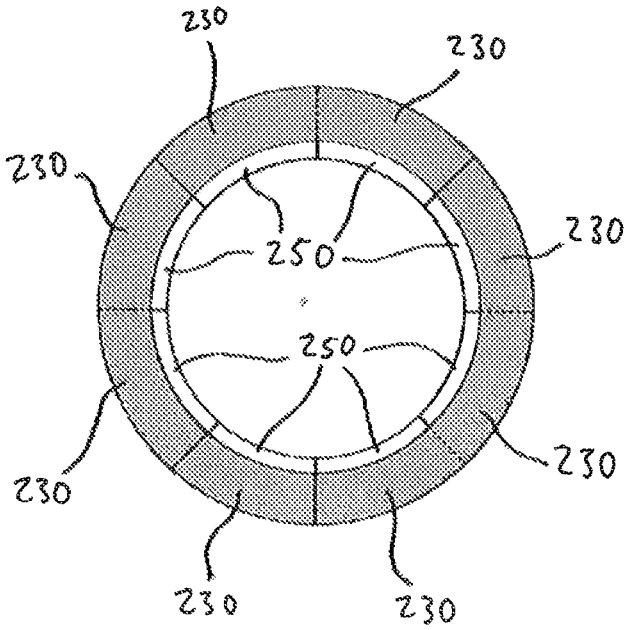
FIG. 8 is a bottom-view of an alternate embodiment of a basketball shooting aid including piezoelectric sensors.

Illustrated in FIG. 8 describes a certain embodiment of a basketball shooting aid 10 that may have a plurality of piezoelectric sensors 230 and a plurality of light-emitting devices 250 connected to a sidewall 100, where a certain piezoelectric sensor may be configured to associate with a certain light-emitting device. It can be appreciated by one skilled in the art that when a certain piezoelectric sensor 230 detects a vibration associated with an impact from an incoming basketball, a detection response is gathered by a processor 220 and instructions are sent to a certain light-emitting device 250.

Figure 9:
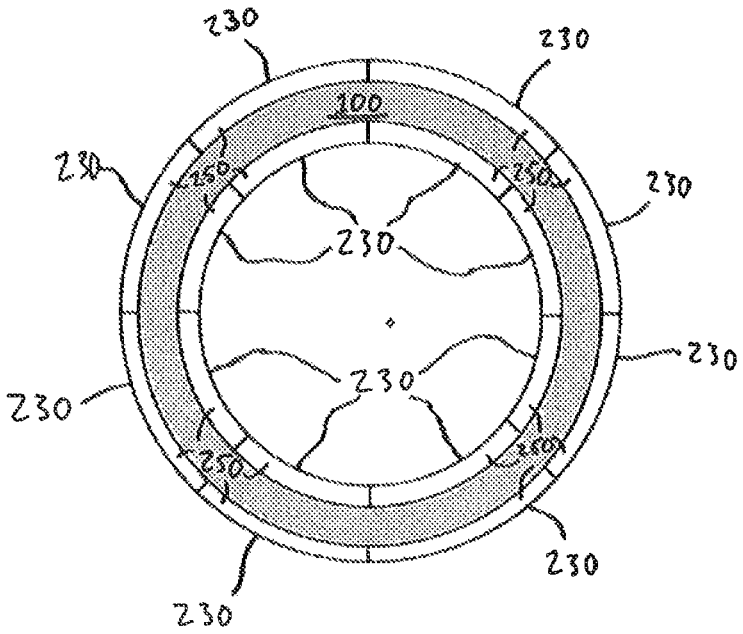
FIG. 9 is a bottom-view of an alternate embodiment of a basketball shooting aid including another arrangement of piezoelectric sensors.

Illustrated in FIG. 9 describes another embodiment of a basketball shooting aid 10 that may have a plurality of light-emitting devices 250 connected to a sidewall 100, and a plurality of piezoelectric sensors 230 connected to the sidewall along an upper surface 110 and a lower surface 120 of a sidewall 100, where a certain piezoelectric sensor may be configured to associate with a certain light-emitting device. It can be appreciated by one skilled in the art that when a certain piezoelectric sensor 230 detects a vibration associated with an impact from an incoming basketball, a certain detection response is gathered by a processor 220 and instructions are then sent to a certain light-emitting device 250. Certain advantages may arise the illustrated arrangement of electric components, as a processor 220 gathers a certain detection response from a piezoelectric sensor 230 that is associated with a certain area along an upper surface 110 and a lower surface 120 of a sidewall 100, where the certain detection response gathered may be useful to determine where an impact from an incoming basketball occurred on the sidewall.

Figure 10:
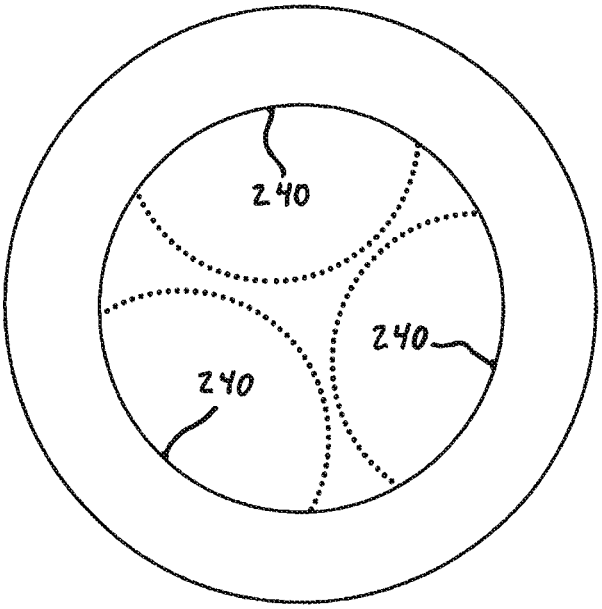
FIG. 10 illustrates a top-view of an alternate embodiment of a basketball showing aid including proximity sensors.

FIG. 10 describes a top-view embodiment of a plurality of proximity sensors 240 that may be adjacent to a lower surface 120 of a sidewall 100, where the figure illustrates that a range of proximity sensor detection may cover enough of a surface area associated with a lower orifice 112 to detect a movement of an incoming basketball that may pass through said lower orifice.

In certain embodiments, a damping layer 136 may have a thickness 138 that is consistent and uniform across an inner surface 130.

In some embodiments, a damping layer 136 may have a thickness 138 that varies across an inner surface 130, and it can appreciated that certain advantages may arise with varying the thickness of the damping layer to be thicker or thinner in certain areas that cover the inner surface.

In another embodiment, a damping layer 136 may have a thickness 138 that is thinner near an upper surface 110 of a sidewall 100 and may gradually become thicker as it nears a lower surface 120 of the sidewall.

In some other embodiments, when a basketball shooting aid 10 is connected to an existing basketball rim 1 having a backboard, a damping layer 136 may have a thickness 138 that is thicker the more proximal said damping layer is to said backboard and may gradually become thinner the more distal said damping layer is to said backboard.

In other embodiments, a damping layer 136 may have a thickness 138 that is thicker in areas on an inner surface 130 of a sidewall 100 that are associated with suffering a higher number of impacts from an incoming basketball.

It can be appreciated that certain advantages may arise with a damping layer 136 being temporarily, semi-permanently, or permanently connected to an inner surface 130 of a sidewall 100. Means for connecting the damping layer to the sidewall, being either temporarily, semi-permanently, or permanently, may be achieved through available means known to the art today including, but not limited to: Velcro, adhesives such as double-sided tape/adhesive, spray adhesives, or liquid adhesives (glues), rubber or liquid cements, and any combination of the listed connection means.

In a preferred embodiment of a basketball shooting aid 10, it can be appreciated that a damping layer 136 may removably connected to an inner surface 130 of a sidewall 100, which may allow the damping layer to be replaced if said damping layer degrades or becomes worn-down.

In one embodiment, a shock-absorbing gasket 126 may be connected to a lower surface 120 of a sidewall 100 and may be sandwiched between an existing basketball rim 1 and the lower surface 120 by similar means for securely connecting a basketball shooting aid 10 to the existing basketball rim 1.

It can be appreciated by one skilled in the art that a damping layer 136 and a shock-absorbing gasket 126 may act in a synergistic relationship. A damping layer 136 and a shock-absorbing gasket 126 are separate elements that have separate functions, but the functions of each element may contribute in absorbing energy associated with an impact from an incoming basketball, as such there may be certain advantages when using said elements in combination.

A damping layer 136 may absorb energy associated with an initial impact from an incoming basketball, which may aid in preventing the incoming basketball from bouncing off a sidewall 100 and out of a basketball shooting aid 10. As the damping layer 136 may absorb energy associated with impact from an incoming basketball, it may reduce the amount of energy transferred to a sidewall 100 and an existing basketball rim 1 for a shock-absorbing gasket 126 to absorb.

A shock-absorbing gasket 126 may absorb energy transferred between the sidewall 100 and an existing basketball rim 1 that is due to an impact associated with an incoming basketball. The energy transferred between a sidewall 100 and an existing rim 1 may resonate back-and-forth between the sidewall and the existing rim, which not only may cause undesirable vibrations or rattling that may affect performance of a basketball shooting aid 10, but also may cause damage to the basketball shooting aid. As the shock-absorbing gasket 126 may absorb energy that may resonate back-and-forth between a sidewall, it may reduce the amount of energy for a damping layer 136 to absorb and aid in preventing a basketball from bouncing off a sidewall 100 and out of the basketball shooting aid 10.

Therefore, it may be appreciated to one skilled in the art that while a damping layer and a shock-absorbing gasket are each separate elements having separate functions, when in combination they may aid each other perform their separate functions. Thus, this may result a synergistic relationship, where the actual sum of the elements may be greater than the individual sum of said elements.

Figure 11:
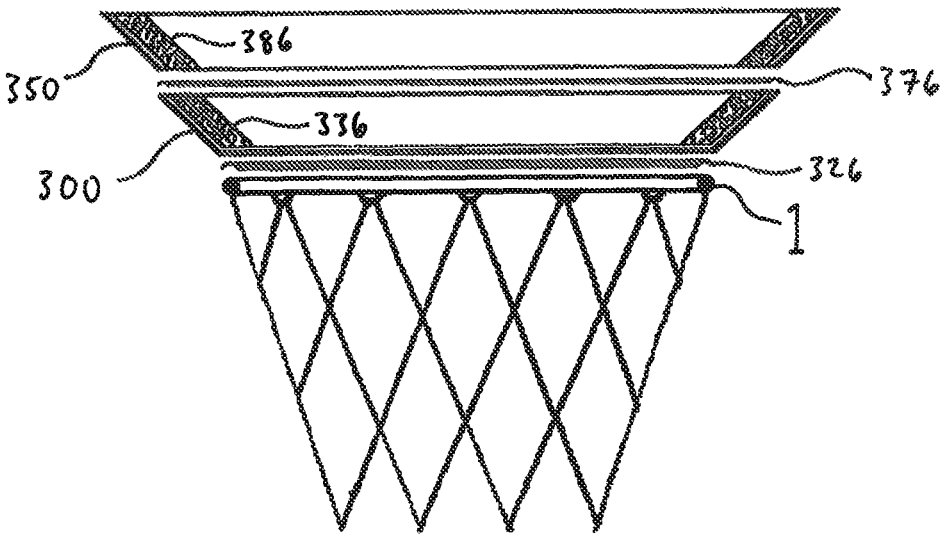
FIG. 11 illustrates a cross-section view of an alternate embodiment of a basketball shooting aid including an upper sidewall and a lower sidewall.
Figure 12:
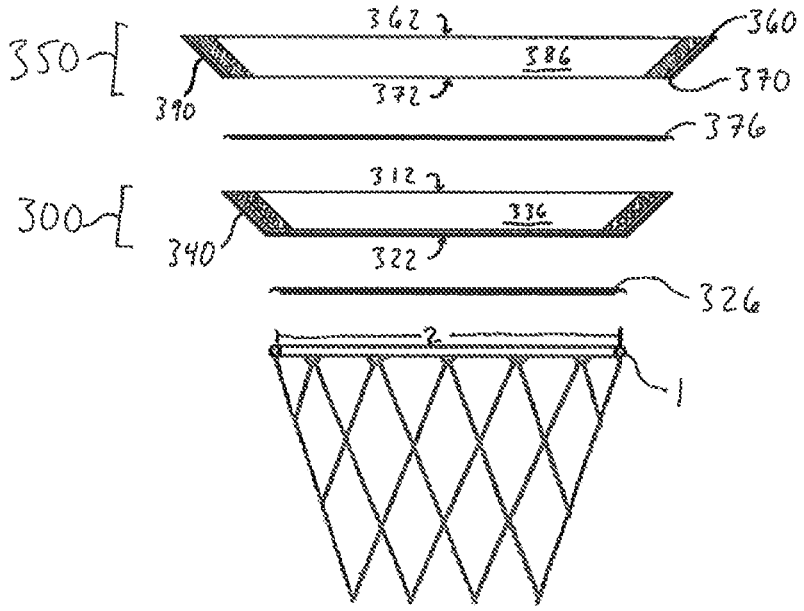
FIG. 12 illustrates an exploded cross-section view of the alternate embodiment shown in FIG. 11.

The illustration in FIG. 11 depicts an alternate embodiment of a basketball shooting aid 10 where a sidewall is a lower sidewall 300. In FIG. 12, a basketball shooting aid 10 may further include an upper sidewall 350 that may be removably connected to the lower sidewall 300. The upper sidewall 350 has upper surface 360, a lower surface 370, an inner surface 380, and an outer surface 390. The upper surface 360 defines an upper orifice 362 and the lower surface 370 defines a lower orifice 372. The upper orifice 362 has an upper orifice diameter 364 and the lower orifice 372 has a lower orifice diameter 374, where the upper orifice diameter is greater than the lower orifice diameter such that the inner surface 380 angles from the upper surface 360 to the lower surface 370. The lower orifice diameter 374 is substantially similar to an upper orifice diameter 314 of a lower sidewall 300.

Referencing FIG. 11, an upper sidewall 350 may also include a shock-absorbing gasket 376 connected to a lower surface 370 and a damping layer 386 covering an inner surface 380. The damping layer 386 may absorb energy associated with an incoming basketball. The shock-absorbing gasket 376 may be sandwiched between an upper sidewall 350 and a lower sidewall 300 when the upper sidewall is removably connected to the lower sidewall.

In one aspect, an upper-most orifice diameter may be associated with an upper-most surface that is most distal to an existing basketball rim. When an upper sidewall 350 is connected to a lower sidewall 300, an upper-most orifice diameter is greater than when the upper sidewall is disconnected from the lower sidewall. Therefore, it can be appreciated by one skilled in the art that the embodiment shown in FIG. 11 may be a modular basketball shooting aid and allow an upper sidewall 350 to be disconnected from a lower sidewall 300 if the upper sidewall is not required by an end-user of the basketball shooting aid 10 to have a greater upper-most orifice diameter.

In another aspect, a shock-absorbing gasket 326 may be connected to a lower surface 320 of a lower sidewall 300 may be sandwiched between an existing basketball rim 1 and the lower surface by similar means for securely connecting a basketball shooting aid 10 to the existing basketball rim. A shock-absorbing gasket 376 may be connected to a lower surface 370 of an upper sidewall 350 may be sandwiched between the lower surface of the upper sidewall and an upper surface 310 of a lower sidewall 300 by means that are the same for securing the upper sidewall to the lower sidewall.

In certain embodiments where an existing basketball rim may exist in an outdoor environment, elements of a basketball shooting aid may be made of materials or arranged in such a way that allows the basketball shooting aid to be weatherproof. It can be appreciated to one skilled in the art that there are numerous ways to manufacture, arrange, package, spray, and/or coat elements of a basketball shooting aid to be weatherproof. Weatherproof may include, but not limited to, the capability to be waterproof, UV-resistant, or a combination thereof.

In some embodiments, elements comprising a basketball shooting aid may be manufactured separately and then be assembled together.

In another embodiment, some elements of a basketball shooting aid, including a sidewall, an upper sidewall, a lower sidewall, a shock-absorbing gasket, and a damping layer may be manufactured as a singular element via advanced additive manufacturing methods.

Although the disclosure has been described with reference to the preferred embodiment(s), it is noted that equivalents may be employed and substitutions made herein without departing from the scope of the disclosure. Thus, the disclosure described herein is entitled to those equivalents and substitutions that perform substantially the same function in substantially the same way.

The invention claimed is:

1. A basketball shooting aid for retrofitting onto an existing basketball rim having a rim diameter, the basketball shooting aid comprising:

a sidewall having an upper surface, a lower surface, an inner surface, and an outer surface, the upper surface of the sidewall defining an upper orifice and the lower surface of the sidewall defining a lower orifice, the upper orifice having an upper orifice diameter, the lower orifice having a lower orifice diameter, the upper orifice diameter being greater than the lower orifice diameter such that the inner surface angles from the upper surface to the lower surface, the lower orifice diameter being substantially similar to the rim diameter of the existing basketball rim;

a shock-absorbing gasket connected to the lower surface of the sidewall;

a damping layer covering the inner surface of the sidewall, the damping layer being configured to absorb energy associated with an incoming basketball;

wherein the shock-absorbing gasket is configured to be sandwiched between the sidewall and the existing basketball rim when the basketball shooting aid is retrofitted onto said existing basketball rim.

2. The basketball shooting aid of claim 1, wherein the sidewall is associated with a first hardness, the shock-absorbing gasket is associated with a second hardness, and the damping layer is associated with a third hardness, the first hardness being greater than the second hardness, and the first hardness being greater than the third hardness.

3. The basketball shooting aid of claim 1, wherein the sidewall has a height defined as a distance between the upper surface and the lower surface, the height being less than the lower orifice diameter.

4. The basketball shooting aid of claim 3, wherein the height of the sidewall is between 2 inches to 10 inches.

5. The basketball shooting aid of claim 1, wherein the lower orifice diameter is generally about 18 inches and the upper orifice diameter is between 20 inches to 28 inches.

6. The basketball shooting aid of claim 1, wherein the upper orifice diameter is between 22 inches to 26 inches.

7. The basketball shooting aid of claim 1, further comprising a processor, a power source, at least one piezoelectric sensor, at least one proximity sensor, and at least one light-emitting device.

8. The basketball shooting aid of claim 7, wherein the power source is connected to the processor, the at least one proximity sensor, the at least one piezoelectric sensor, and the at least one light-emitting device, said power source is configured to deliver adequate amounts of energy for said processor, said at least one proximity sensor, said at least one piezoelectric sensor, and said at least one light-emitting device to operate.

9. The basketball shooting aid of claim 7, wherein the at least one light-emitting device, the at least one piezoelectric sensor, and the at least one proximity sensor are in communication with the processor.

10. The basketball shooting aid of claim 7, wherein the processor and the power source are connected to the outer surface of the sidewall.

11. The basketball shooting aid of claim 7, wherein the at least one piezoelectric sensor is connected to the sidewall, said at least one piezoelectric sensor configured to detect a vibration associated with an impact from an incoming basketball.

12. The basketball shooting aid of claim 7, wherein the at least one proximity sensor is adjacent to the lower orifice, the at least one proximity sensor configured to detect movement associated with an incoming basketball.

13. The basketball shooting aid of claim 7, wherein the processor is configured to collect and record at least one detection response from the at least one piezoelectric sensor and the at least one proximity sensor, and to deliver a command to the at least one light-emitting device, said command associated with at least one detection response collected by said processor.

14. The basketball shooting aid of claim 1, wherein the sidewall comprises a lower side wall;

the basketball shooting aid further comprising an upper sidewall configured to be removably connected to said lower sidewall, said upper sidewall having an upper surface, a lower surface, an inner surface, and an outer surface, the upper surface of the upper sidewall defining an upper orifice and the lower surface of the upper sidewall defining a lower orifice, the upper orifice having an upper orifice diameter and the lower orifice having a lower orifice diameter, the upper orifice diameter greater than the lower orifice diameter such that the inner surface angles from the upper surface to the lower surface, the lower orifice diameter being substantially similar to the upper orifice diameter of the lower sidewall;

a shock-absorbing gasket connected to the lower surface of the upper sidewall;

a damping layer covering the inner surface of the upper sidewall, the damping layer being configured to absorb energy associated with an incoming basketball;

wherein the shock-absorbing gasket is sandwiched between the upper sidewall and the lower sidewall when the upper sidewall is removably connected to the lower sidewall.

15. The basketball shooting aid of claim 14, wherein an upper-most orifice diameter is associated with an upper surface most distal to the existing basketball rim, said upper-most orifice diameter having a greater diameter when the upper sidewall is connected to the lower sidewall as compared to when the upper sidewall is disconnected from the lower sidewall.

* * * * *